United States Patent [19]

Narozny et al.

[11] 4,295,704

[45] Oct. 20, 1981

[54] SIDE PROBEABLE CONNECTOR USING FLAT CABLE

[75] Inventors: Ronald S. Narozny, Panorama City; Robert P. Wyss, Manhattan Beach, both of Calif.

[73] Assignee: Thomas & Betts Corporation, Raritan, N.J.

[21] Appl. No.: 99,521

[22] Filed: Dec. 3, 1979

[51] Int. Cl.[3] ..... H01R 13/50

[52] U.S. Cl. ..... 339/99 R; 339/150 B

[58] Field of Search ..... 339/99 R, 176 MF, 17 F, 339/61 M, 278 M, 95–98, 100, 150 B, 151 B, 149 P, 103

[56] References Cited

U.S. PATENT DOCUMENTS 3,778,753 12/1973 Occhipinti ..... 339/151 B X
4,006,957 2/1977 Narozny ..... 339/103 M X
4,023,879 5/1977 Braund et al. ..... 339/17 R X
4,030,799 6/1977 Venaleck ..... 339/99 R

*Primary Examiner*—John McQuade
*Assistant Examiner*—John S. Brown
*Attorney, Agent, or Firm*—Robert M. Rodrick; Jesse Woldman

[57] ABSTRACT

The invention teaches the incorporation of passages in a fully enclosed cable connector, through which an electrical probe can be inserted to engage the electrical contacts therein permitting the related electrical circuits to be checked. The passages are placed in the connector body or cover and are probeable from one or both sides so that the contacts can be engaged regardless of the position of the connector with respect to its mounting or the cable position or the incorporation of cable strain reliefs.

18 Claims, 6 Drawing Figures

SIDE PROBEABLE CONNECTOR USING FLAT CABLE

BACKGROUND OF THE INVENTION

1. Field of the Invention

The invention is directed to cable connectors and more particularly to cable connectors which facilitate the checking out of circuits and cables associated with the contacts of an electrical connector.

2. Description of the Prior Art

In most instances, the prior art provides no means by which a check of circuits or cables can be made starting at one end with the contacts of the electrical connector. U.S. Pat. No. 4,030,799, issued June 21, 1977, to John T. Venaleck entitled "Jumper Connector" does provide for the probing of the contacts of the connector by providing an aperture in its base body part. The aperture is opened to the bottom surface only of the base body part and thus cannot be reached if the connector is mounted base body part down, or if the cable is folded over the bottom surface of the base body part or if a strain relief is added over the bottom surface of the base body part. Thus, despite the presence of openings for the admission of a probe to the contacts within the enclosed connector, they are often rendered unusable.

SUMMARY OF THE INVENTION

The present invention overcomes the difficulties noted above with respect to prior art devices by the inclusion of probe passages in a fully enclosed cable connector whereby the electrical contacts therein can be engaged by an external probe inserted through such passages to permit the circuits and cables connected to such electrical contacts to be checked. In a first embodiment, probe passages are placed in the connector body portion adjacent the cable portion to permit a probe to be inserted therein to engage the electrical contact at the end of such passage. In a further embodiment, passages extend completely through the connector body portion so that a probe inserted from either side of the body portion can engage portions of the two electrical contacts which intrude into such passage. In other embodiments, passages are placed in the cable connector cover so that single contacts may be engaged or which permit the two adjacent contacts partially intruding into the common passage to be engaged. It is therefore an object of this invention to provide a side probeable electrical cable connector.

It is another object of this invention to provide a side probeable electrical cable connector wherein the electrical contacts thereof can be engaged regardless of direction of mounting of such connector, the position of the cable or the presence of strain relief devices.

It is another object of this invention to provide probing passages in the body of an electrical cable connector permitting the probing of single electrical contacts in the connector.

It is another object of this invention to provide probing passages completely through the body of an electrical cable connector permitting the probing of the two adjacent electrical contacts which intrude into such passages.

It is still another object of this invention to provide probing passages in the cover of an electrical cable connector permitting the probing of a single electrical contact in the connector.

It is yet another object of this invention to provide probing passages completely through the cover of an electrical cable connector permitting the probing of the two adjacent electrical contacts which intrude into such passages.

Other objects and features of the invention will be pointed out in the following description and claims and illustrated in the accompanying drawings, which disclose, by way of example, the principles of the invention, and the best modes which have been contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
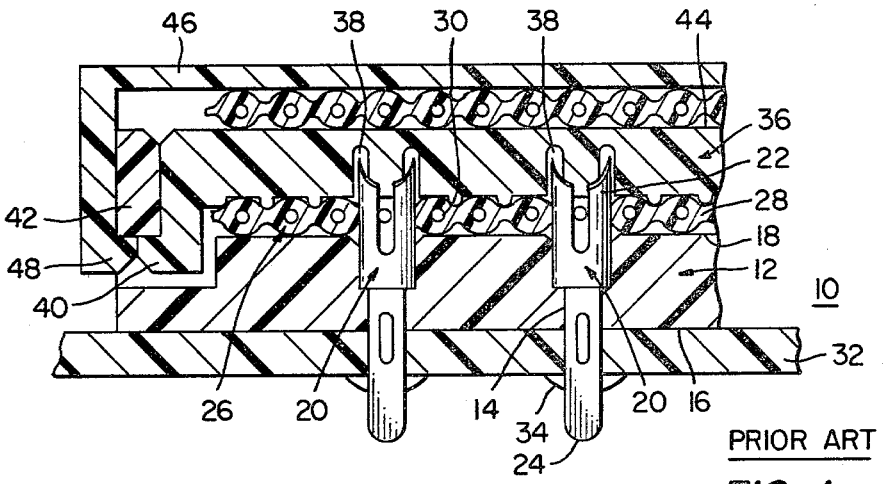
PRIOR ART FIG. 1
FIG. 1 is a fragmentary front elevation, partly in section, of a prior art strain relieved electrical cable connector installed to a multiconductor flat cable.
Figure 2:
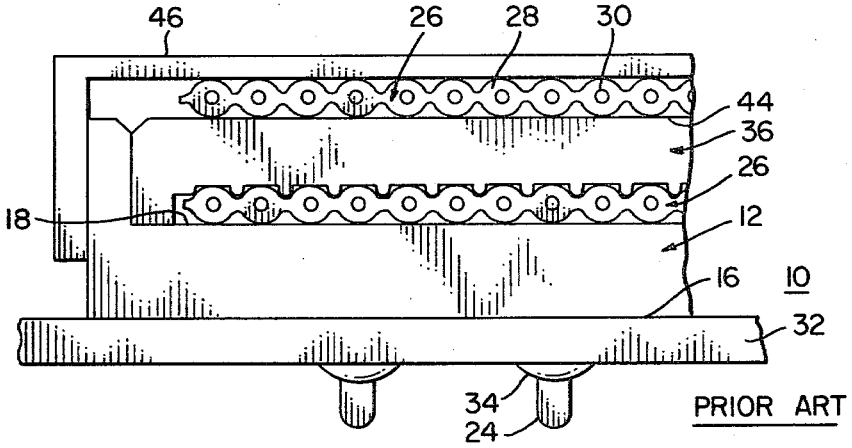
PRIOR ART FIG. 2
FIG. 2 is the installed connector of FIG. 1 insectioned.

Turning now to FIGS. 1 and 2, there is shown a fully enclosed electrical cable connector 10 according to the prior art composed of a base portion 12 having a plurality of bores 14 from a first surface 16 to a second surface 18 thereof. Electrical contacts 20, one of which is placed in each of the bores 14, have a cable engaging portion 22 and a contact tail portion 24. Cable engaging portion 22 is arranged to pierce the insulation 28 of a multiconductor flat cable 26 and make a good electrical contact with its associated conductor 30 of such cable 26. The tail end portion 24 is arranged to be plugged into the plated-through apertures in a printed circuit board 32 and soldered to the back surface thereof as at 34, or plugged into a suitable connector (not shown) coupled to another cable, a printed circuit board or the like.

After the cable engaging portion 22 passes through cable 26, it enters the annular recess 38 in the cover 36 of the connector. Cover 36 is secured to body portion 12 by a latch arm 40 which engages a retainer 42 on body portion 12. As a result, the electrical contacts 26 are fully contained in the bores 14, the cable 26 and the recesses 38 providing no external access to the contacts 26. To provide strain relief for the cable 26, the cable 26 is folded over the top surface 44 of cover 36 and a strain relief 46 is placed over the folder-over portion of the cable 26 above top surface 44 of cover 36. Strain relief 46 is held in place by latch arms 48 engaging retainer 42 on body portion 12. The folding over of the cable 26 and the use of strain relief 46 prevent any probing of the contacts 20 from the top of the connector 10 via the top surface 44 of cover 36. Thus, the use of a strain relief as above described renders the approach of the cited prior art U.S. Pat. No. 4,030,799 ineffective to permit the electrical contacts 20 to be externally probed.

Figure 3:
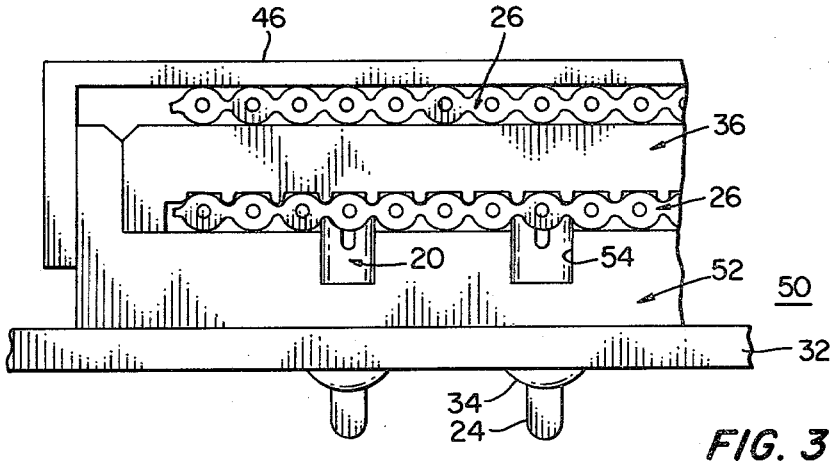
FIG. 3 is a fragmentary front elevational view of a first embodiment of a connector constructed in accordance with the concepts of the invention.

Turning now to FIG. 3, there is shown a connector 50 constructed in accordance with the concepts of the invention. Body portion 52 has been modified to provide passages 54 from the side walls of the body portion 52 to each of the individual contacts 20. Although only the passages 54 for one side of the body portion 52 are visible in FIG. 3, similar passages 54 for the intermediate contacts 20 extend inwardly to these contacts from the opposite side wall, not visible in the figure, so that each contact 20 can be engaged individually by a probe inserted in the corresponding passage 54. The axes of each of the passages 54 is transverse to the longitudinal axis of the bore 14 and the passages 54 communicate with one associated bore 14 so that a probe inserted into a passage 54 will be permitted to engage only a single contact 20. Because of the natural offset of one row of contacts 20 with respect to the other, the axes of the passages 54 extending inwardly from one side wall will be laterally offset with respect to the axes of the passages extending inwardly from the other side wall.

Figure 4:
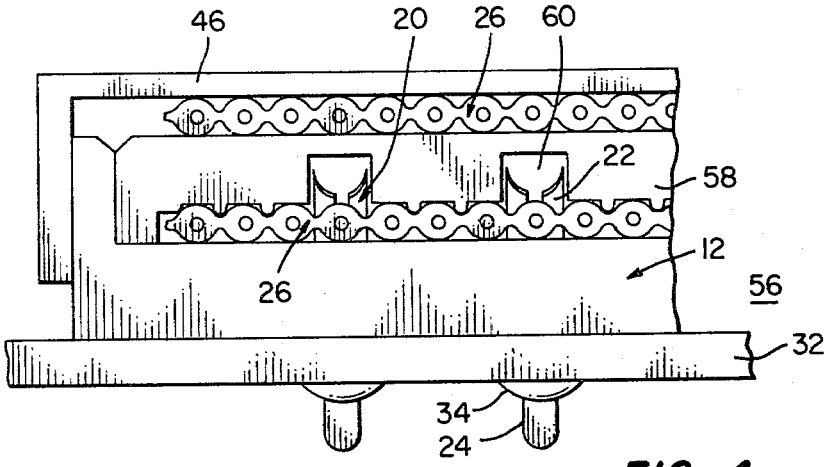
FIG. 4 is a fragmentary front elevational view of another embodiment of a connector constructed in accordance with the concepts of the invention.
Figure 5:
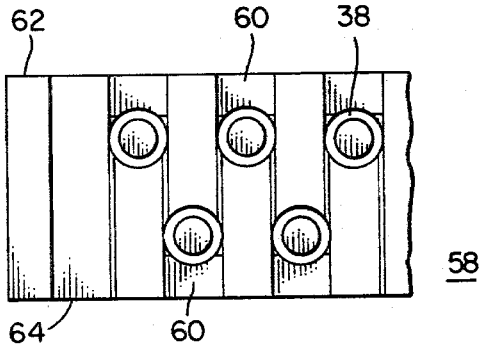
FIG. 5 is a fragmentary bottom plan view of the cover of the connector of FIG. 4.

Alternatively, passages 60 can be placed in the modified cover 58 of connector 56 of FIGS. 4 and 5. Each contact 20 can be engaged by an external probe inserted in the passages 60 which open from both side walls 62, 64 respectively of cover 58. The arrangement of the passages 60 will be the same as above described with respect to the passages 54.

Figure 6:
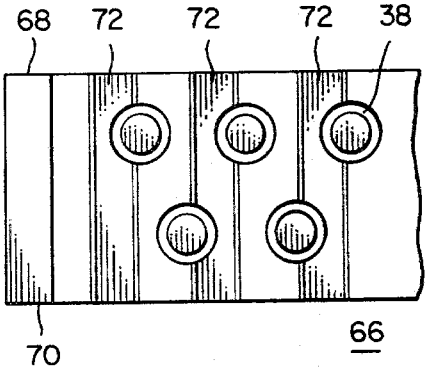
FIG. 6 is a fragmentary bottom plan view of yet another embodiment of a connector constructed in accordance with the concepts of the invention.

In the event the connector 56 is mounted against a panel or printed circuit board to cover one set of passages 60 only one half of the contacts 20 are probeable. To prevent such an occurrence, the arrangement of passages shown in FIG. 6 is employed. Modified cover 66 has a series of passages 72 which extend from side wall 68 to side wall 70 of the modified cover 66. The axes of the passages 72 will be transverse to the longitudinal axis of the recesses 38 and intermediate the longitudinal axes of two adjacent recesses and thus will expose portions of the two adjacent contacts in the two adjacent recesses. An insulated probe with exposed tip can now be entered into the passages 72 from either side will 68, 70 respectively and made to engage either of the two adjacent contacts 20 that intrude into such passages 72 when seated in the recesses 38 when the connector is closed.

The same arrangement can be made for the passages 54 of the body 52 of connector 50 of FIG. 3. The position of the passages 54 has only to be shifted so that portions of two adjacent contacts 20 in different contact rows are exposed by the passages 54 to permit either side contact probing.

In summary of the foregoing, the invention will be seen to involve an electrical connector of type including an elongate body part which supports first and second sets of elongate insulation-piercing contacts, one set being longitudinally staggered in the body part with respect to the other set and laterally offset therefrom. A cover is securable to the body and encases end portions of the contacts extending beyond the flat cable received by the connector. Contact probing passages extend transversely to the contact longitudinal axes, through the cover or base, or both cover and base, and open exteriorly of the connector to provide access to the contacts. In one embodiment, the passages are in number corresponding to the number of contacts, i.e., each passage extends to a discrete contact. In alternate embodiment, each passage extends to plural contacts, whereby the probing passages are in number equal to one-half of the number of contacts. In this embodiment, the passages preferably open into opposed sides of the connector whereby all contacts are accessible from each of two exterior sides of the connector.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A side probeable electrical connector for terminating a multiconductor electrical cable comprising: a body portion having a first and a second surface in parallel spaced apart relationship and first and second walls spaced apart from each other and generally orthogonal with said first and second surfaces; said body portion defining at least two spaced bores from said first to said second surface; at least two electrical contacts, one such contact positioned in an associated bore and extending from said second surface to and beyond said first surface; a cover portion for locking engagement with said body portion and having a first surface and a second surface spaced apart from and generally parallel with said first surface of said cover portion; at least two annular recesses in said first surface of said cover portion for receipt respectively of a portion of said electrical contacts after same passes through an electrical cable placed between said first surfaces of said body portion and said cover portion; and at least one passage in said body portion having an axis transverse to the longitudinal axes of said bores and extending from one of said first and second walls to and communicating with said bores to permit said contacts to be probed by probe means inserted from outside of said body portion.

2. A connector as defined in claim 1, wherein the axis of each said passage extending inwardly from said second wall is laterally offset with respect to the axis of each said passage extending inwardly from said first wall.

3. A connector defined claim 1, wherein the axis of said passage is intermediate the longitudinal axes of two adjacent bores and said passage extends between said first and said second walls communicating with such adjacent bores to expose portions of two adjacent contacts in said two adjacent bores to probe means inserted into said passages.

4. A side probeable electrical connector for terminating a multiconductor electrical cable comprising: a body portion having a first and a second surface in parallel spaced apart relationship; said body portion defining at least two spaced bores from said first to said second surface; at least two electrical contacts, one such contact positioned in an associated bore and extending from said second surface to and beyond said first surface; a cover portion for locking engagement with said body portion and having a first surface and a second surface spaced apart from and generally parallel with said first surface of said cover portion and first and second walls spaced apart from each other and generally orthogonal with said first and second surfaces of said cover portion; at least two annular recesses in said first surface of said cover portion for receipt respectively of a portion of said electrical contacts after same passes through an electrical cable placed between said first surfaces of said body portion and said cover portion; and at least one passage in said cover portion having an axis transverse to the longitudinal axes of said bores and extending from one of said first and second walls to and communicating with said recesses to permit said contacts to be probed by probe means inserted from outside of said body portion.

5. A connector as defined in claim 4, wherein the axis of each said passage extending inwardly from said second wall is laterally offset with respect to the axis of each said passage extending inwardly from said first wall.

6. A connector as defined in claim 4, wherein the axis of said passage is intermediate the longitudinal axes of two adjacent recesses and said passage extends between said first and said second walls communicating with such adjacent recesses to expose portions of two adjacent contacts in said two adjacent recesses to probe means inserted into said passage.

7. In a connector for electrical conductors having a body portion containing a plurality of spaced elongate electrical contacts and a cover portion arranged to lockingly engage said body portion about an electrical conductor inserted therein and engaged by said electrical contacts; a passage through a side wall of said body portion having an axis transverse to the longitudinal axes of said electrical contacts, said passage extending to and communicating with plural of said contacts to permit said contacts to be probed by probe means inserted from outside of said body portion.

8. In a connector as defined in claim 7, wherein the axis of said passage is intermediate the longitudinal axes of two adjacent electrical contacts and said passage extends through said body portion and the wall defining said body portion to expose portions of said two adjacent contacts to probe means inserted into said passage.

9. In a connector for electrical conductors having a body portion containing a plurality of spaced elongate electrical contacts and a cover portion arranged to lockingly engage said body portion about an electrical conductor inserted therein and engaged by said electrical contacts; a passage through a side wall of said cover portion having an axis transverse to the longitudinal axes of said electrical contacts, said passage extending to and communicating with plural of said contacts to permit said contacts to be probed by probe means inserted from outside of said cover portion.

10. In a connector as defined in claim 9, wherein the axis of said passage is intermediate the longitudinal axis of two adjacent electrical contacts and said passage extends through said cover portion and the walls defining said cover portion to expose portions of said two adjacent contacts to probe means inserted into said passage.

11. An electrical connector comprising an elongate body supporting first and second sets of spaced elongate insulation piercing contacts, said first set contacts being longitudinally staggered in said body with respect to said second set contacts and laterally offset therefrom and a cover securable to said body for encasing end portions of said contacts, said connnector including contact probing passages extending transversely to the longitudinal axes of said contacts and opening exteriorly of said connector, at least one of said passages communicating with a contact of each of such first and second sets.

12. A connector as defined in claim 11, wherein said passages extend through said body and are in number corresponding to the number of said contacts.

13. A connector as defined in claim 11, wherein said passages extend through said cover and are in number corresponding to the number of said contacts.

14. A connector as defined in claim 11, wherein said passages are in number equal to one-half of the number of said contacts, each such passage extending to a contact of each of such first and second contacts sets.

15. An electrical connector comprising a body supporting insulation piercing contacts and a cover securable to said body for encasing end portions of said contacts, said connector including a plurality of contact probing passages, each such passage extending to plural of said contacts and opening exteriorly of said connector.

16. A connector as defined in claim 15, wherein each said passage opens into opposed sides of said connector.

17. A connector as defined in claim 11, wherein said passages are in number less than the number of said contacts.

18. A connector as defined in claim 16, wherein each said passage lies transversely relative to the direction of said contacts, each passage communicating with a pair of such contacts.

* * * * *